US010933552B2

(12) United States Patent
Baxter et al.

(10) Patent No.: US 10,933,552 B2
(45) Date of Patent: Mar. 2, 2021

(54) KNIVES AND KNIFE ASSEMBLIES FOR SLICING MACHINES AND SLICING MACHINES EQUIPPED THEREWITH

(71) Applicant: URSCHEL LABORATORIES, INC., Chesterton, IN (US)

(72) Inventors: Corey Everette Baxter, Valparaiso, IN (US); Dustin Joseph Gereg, Lowell, IN (US); Steven Eugene Dudley, Perrysburg, OH (US)

(73) Assignees: Urschel Laboratories, Inc., Chesterton, IN (US); Crescent Manufacturing Company, Fremont, OH (US)

( * ) Notice: Subject to any disclaimer, the term of this patent is extended or adjusted under 35 U.S.C. 154(b) by 0 days.

(21) Appl. No.: 16/436,068

(22) Filed: Jun. 10, 2019

(65) Prior Publication Data

US 2019/0375126 A1 Dec. 12, 2019

Related U.S. Application Data

(60) Provisional application No. 62/682,386, filed on Jun. 8, 2018.

(51) Int. Cl.

| | |
|---|---|
| ***B26D 7/26*** | (2006.01) |
| ***B26D 7/06*** | (2006.01) |
| ***B26D 1/03*** | (2006.01) |

(52) U.S. Cl.

CPC ..... *B26D 7/2614* (2013.01); *B26D 1/03* (2013.01); *B26D 7/0691* (2013.01); *B26D 2210/02* (2013.01)

(58) Field of Classification Search

CPC ..... B26D 7/2614; B26D 7/0691; B26D 1/03; B26D 2210/02; B26D 7/08; B26D 3/28; (Continued)

(56) References Cited

U.S. PATENT DOCUMENTS 1,477,488 A * 12/1923 Holland ..... B24D 15/084 30/138

3,139,128 A 6/1964 Urschel et al.

(Continued)

FOREIGN PATENT DOCUMENTS

| | | |
|---|---|---|
| JP | 2006076166 | 3/2006 |
| WO | 9601148 | 1/1996 |

OTHER PUBLICATIONS

International Search Report and Written Opinion for International Application No. PCT/US2019/036330, filed Jun. 10, 2019, dated Oct. 4, 2019, (9 pages).

*Primary Examiner* — Ghassem Alie

(74) *Attorney, Agent, or Firm* — Hartman Global IP Law; Gary M. Hartman; Domenica N. S. Hartman

(57) ABSTRACT

Knives and knife assemblies for slicing machines and centrifugal-type slicing machines equipped therewith. Such a knife includes a cutting edge and an opposing edge oppositely disposed from the cutting edge. The cutting and opposing edges extend along a longitudinal length of the knife, and the knife has a handle at a longitudinal end of the knife. A transition region is between the cutting edge and the handle, and the transition region has a minimum lateral width of roughly one half of a lateral width between the cutting and opposing edges of the knife, with the result that a portion of the knife that laterally extends beyond the transition region is up to roughly half of a lateral width of the knife between the cutting and opposing edges.

16 Claims, 8 Drawing Sheets

(58) Field of Classification Search
CPC ..... B26D 33/26; B26D 1/0006; B26D 9/00; B26D 1/36; B26D 1/147; B26D 1/29; B26D 1/62; B26D 7/2628; Y10T 83/6473; Y10T 83/9457; Y10T 83/9488
USPC ..... 83/403, 698.11, 402, 404, 407, 408, 83/698.51, 598.61; 30/280, 281, 339, 30/334; 241/89.3, 84, 85, 242, 285.1, 241/285.2
See application file for complete search history.

(56) References Cited

U.S. PATENT DOCUMENTS 3,139,129 A 6/1964 Urschel et al.
5,479,711 A * 1/1996 Hathcock ..... B23D 49/165 30/393
5,694,824 A 12/1997 Jacko et al.
6,968,765 B2 11/2005 King
7,658,133 B2 2/2010 Jacko et al.
8,161,856 B2 4/2012 Jacko et al.
8,714,068 B2 * 5/2014 Ornelaz, Jr. ..... B26D 7/2614 83/403
9,193,086 B2 11/2015 Jacko et al.
9,469,041 B2 10/2016 King et al.
9,517,572 B2 12/2016 Michel et al.
2006/0026843 A1 * 2/2006 Rudisill ..... B26B 1/04 30/153
2007/0044323 A1 * 3/2007 Chao ..... B26B 5/00 30/329
2007/0169351 A1 * 7/2007 Steigerwalt ..... B26B 1/042 30/155
2013/0232796 A1 * 9/2013 Nikas ..... B26B 19/06 30/208
2014/0090536 A1 4/2014 Ornelaz, Jr.
2015/0174777 A1 6/2015 Jacko et al.
2015/0224664 A1 8/2015 Harkness et al.
2016/0158953 A1 6/2016 King et al.
2016/0361831 A1 12/2016 Fant

* cited by examiner

KNIVES AND KNIFE ASSEMBLIES FOR SLICING MACHINES AND SLICING MACHINES EQUIPPED THEREWITH

CROSS-REFERENCE TO RELATED APPLICATIONS

This application claims the benefit of U.S. Provisional Application No. 62/682,386 filed Jun. 8, 2018. The contents of this prior application are incorporated herein by reference.

BACKGROUND OF THE INVENTION

The present invention generally relates to machines for cutting products, including but not limited to slicing machines adapted for slicing food products. The invention particularly relates to knives and knife assemblies for use with centrifugal-type slicing machines.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC and CCL machines are centrifugal-type slicers capable of slicing a wide variety of products at high production capacities. The Model CC® line of machines is particularly adapted to produce uniform slices, strip cuts, shreds and granulations. Certain configurations and aspects of Model CC® machines are represented in U.S. Pat. Nos. 3,139,128, 3,139,129, 5,694,824 and 6,968,765, the entire contents of which are incorporated herein by reference.

FIG. 1 schematically depicts a machine 10 representative of a Model CC® machine. The machine 10 includes a generally annular-shaped cutting head 12 equipped with cutting knives (not shown) mounted at its inner circumference. An impeller 14 is coaxially mounted within the cutting head 12 and has an axis 17 of rotation that coincides with an axis of the cutting head 12. The impeller 14 is rotationally driven about its axis 17 through a shaft that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, as the hopper 11 delivers products to the impeller 14, centrifugal forces cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including improved embodiments thereof, can be appreciated from U.S. Pat. Nos. 3,139,128, 3,139,129, 5,694,824, 6,968,765, 7,658,133, 8,161,856, 9,193,086, 9,469,041, and 9,517,572 and U.S. Patent Application Publication Nos. 2016/0158953 and 2016/0361831, the entire contents of which are incorporated herein by reference.

FIGS. 2 and 3 contain isolated views of an embodiment of a cutting head 12 disclosed in copending U.S. patent application Ser. No. 16/394,048, filed Apr. 25, 2019, capable of use with a variety of cutting machines, including the Model CC® slicing machine 10 depicted in FIG. 1, and in some instances may be a modification or retrofit for such a machine. The cutting head 12 will be described hereinafter in reference to the slicing machine 10 of FIG. 1 equipped with an impeller 14 as described in reference to FIG. 1. On the basis of the coaxial arrangement of the cutting head 12 and the impeller 14, relative terms including but not limited to "axial," "circumferential," "radial," etc., and related forms thereof may be used below to describe the cutting head 12 represented in FIG. 2.

In the isolated view of FIG. 2, the cutting head 12 can be seen to be generally annular-shaped with cutting knives 20 mounted at its perimeter. Each knife 20 projects radially inward in a direction generally opposite the direction of rotation of the impeller 14 within the cutting head 12, and defines a cutting edge at its radially innermost extremity. The cutting head 12 further comprises lower and upper support rings 22 and ring 24 to and between which circumferentially-spaced slicing units 26 are mounted, each defining a cutting station of the cutting head 12. The knives 20 of the cutting head 12 are individually secured with clamping assemblies 28 to the slicing units 26. As more readily evident in FIG. 3, the clamping assembly 28 of each slicing unit 26 includes a knife holder 30 mounted with fasteners 32 to and between a pair of mounting blocks 34, which in turn are configured to be secured to the support rings 22 and 24 with fasteners 36 that rigidly secure the mounting blocks 34 to the rings 22 and 24. Each clamping assembly 28 further includes a clamp 31 positioned on the radially outward-facing side of the holder 30 to secure a knife 20 thereto. As shown in FIG. 3, the knife 20 is supported by a radially outer surface of the knife holder 30, and the clamp 31 overlies the holder 30 so that the knife 20 is between the surface of the holder 30 and a radially inward surface of the clamp 31 that faces the holder 30. Alignment of the knife 20, holder 30, and clamp 31 is achieved with pins 48 that protrude from the knife holder 30 into complementary slots and holes in, respectively, the knife 20 and clamp 31. By forcing the clamp 31 toward the holder 30, the clamp 31 will apply a clamping force to the knife 20 adjacent its cutting edge.

FIGS. 2 and 3 further show each slicing unit 26 as comprising an adjustable gate 40 secured to the mounting blocks 34 with fasteners 42. A food product crosses the gate 40 prior to encountering the knife 20 mounted to the succeeding slicing unit 26, and together the cutting edge of a knife 20 and a preceding trailing edge 46 of the preceding gate 40 define a gate opening that determines the thickness of a slice produced by the knife 20. To provide relatively fine control of the thickness of a sliced product, the mounting blocks 34 are equipped with adjustment screws 44 that engage the gates 40 to alter the radial location of their trailing edges 46 relative to the cutting edge of the succeeding knife 20.

As shown in FIG. 3, an eccentric cam rod 50 is used as a quick-clamping feature to apply the clamping force to the clamp 31. The cam rod 50 passes through holes in the mounting blocks 34 and through complementary holes to loosely assemble the clamp 31 to the mounting blocks 34 in combination with the pivot axis of the clamp 31 created by the fasteners 36. Clockwise rotation of the cam rod 50 (as viewed in FIG. 3) causes the cam rod 50 to eccentrically move into engagement with the surface of the clamp 31, forcing the clamp 31 into engagement with the knife 20. The force applied to the clamp 31 by the cam rod 50 can be released by rotating the cam rod 50 counterclockwise.

The clamp 31 is pivotably mounted to the mounting blocks 34, and in the embodiment shown the fasteners 36 that secure the mounting blocks 34 to the rings 22 and 24 extend through the blocks 34 to also serve as pivot pins for the clamp 31. The mounting blocks 34 are equipped with pins 38 that engage holes in the support rings 22 and 24. By appropriately locating the holes in the rings 22 and 24, the orientation of the mounting blocks 34, and consequently the knife 20, knife holder 30, and clamp 31 mounted thereto, can be used to alter the radial location of the cutting edge of the knife 20 with respect to the axis of the cutting head 12, thereby providing relatively coarse control of the thickness of the sliced food product.

FIG. 4 depicts an isolated view of one of the knives 20, and shows slots 52 in an edge 55 of the knife 20 opposite its edge cutting edge 54 for engaging the pins 48 that protrude from the knife holder 30. In addition, the knife 20 has a handle 56 at its upper longitudinal end that protrudes through an opening in the upper support ring 24, as seen in FIGS. 2 and 3. The handle 56 enables the knife 20 to be grasped and easily removed from the cutting head 12 after the clamping force applied by the clamp 31 and cam rod 50 to the knife 20 has been released by rotating the rod 50. FIG. 5 depicts another configuration for the knife 20 that was disclosed in U.S. Pat. No. 5,694,824 for use in centrifugal-type slicers manufactured by Urschel Laboratories, Inc. The lateral widths of the knife handles 56 seen in FIGS. 4 and 5 differ, with the result that a greater portion 60 of the knife 20 in FIG. 5 laterally extends beyond its handle 56, as visualized by the extension line 62 of the handle 56, than the knife 20 having the wider handle 56 in FIG. 4. The wider handle 56 of the knife 20 in FIG. 4 enables the knife 20 to be more easily grasped and removed from the cutting head 12.

BRIEF DESCRIPTION OF THE INVENTION

The present invention provides knives and knife assemblies for slicing machines and centrifugal-type slicing machines equipped therewith.

According to one aspect of the invention, a knife includes a cutting edge and an opposing edge oppositely disposed from the cutting edge. The cutting and opposing edges extend along a longitudinal length of the knife, and the knife has a handle at a longitudinal end of the knife. A transition region is between the cutting edge and the handle, and the transition region has a minimum lateral width of roughly one half of a lateral width between the cutting and opposing edges of the knife, with the result that a portion of the knife that laterally extends beyond the transition region is up to roughly half of a lateral width of the knife between the cutting and opposing edges.

According to another aspect of the invention, a knife assembly is provided comprising a knife as described above.

According to yet another aspect of the invention, a slicing machine is provided comprising a cutting head and a knife assembly that is mounted to the cutting head and comprises a knife as described above.

Other aspects and advantages of this invention will be appreciated from the following detailed description.

DETAILED DESCRIPTION OF THE INVENTION

Figure 6:
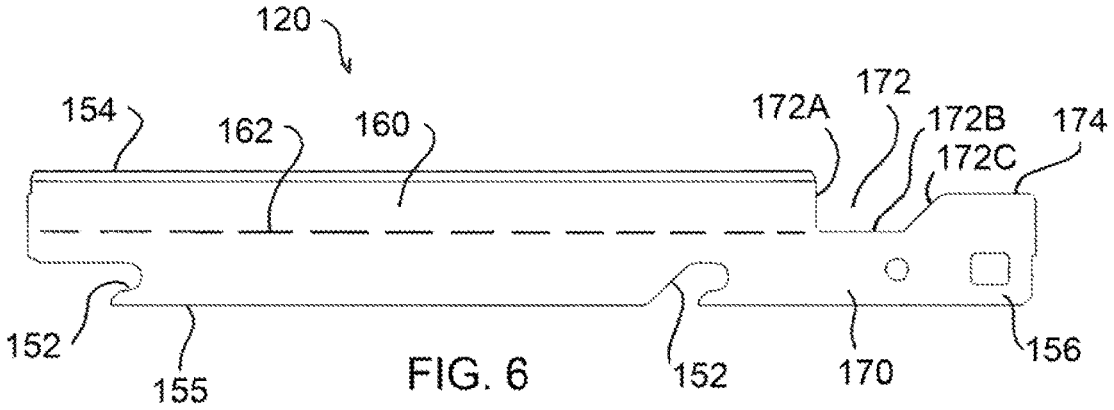
FIGS. 6 and 7 show isolated views of a knife and knife holder, respectively, suitable for use with the cutting head of FIGS. 2 and 3.
Figure 7:
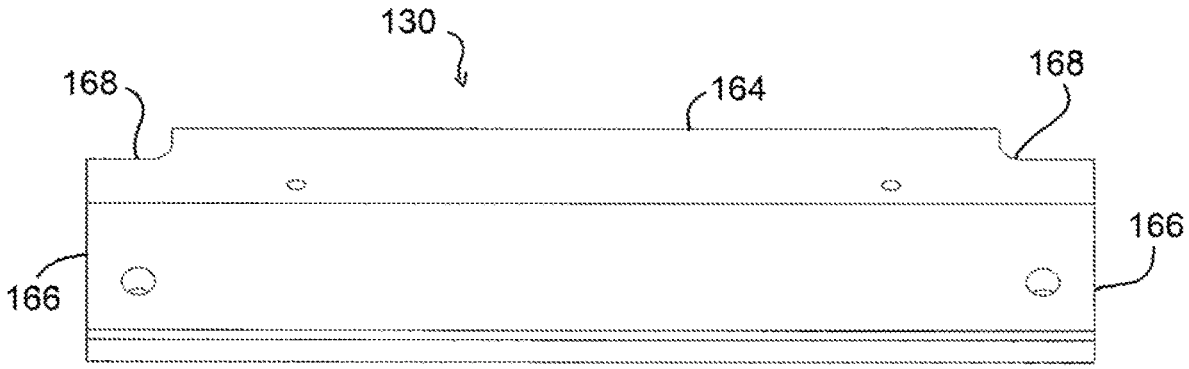

FIGS. 6 and 7 respectively represent nonlimiting embodiments of a cutting knife 120 and knife holder 130 capable of being installed in the cutting head 12 of FIGS. 2 and 3, and FIGS. 8 through 10 contain various views of the cutting head 12 in which the knife 120 and knife holder 130 are installed. The cutting head 12 will be described hereinafter in reference to the slicing machine 10 of FIG. 1 equipped with an impeller 14 as described in reference to FIG. 1, and as such the following discussion will focus primarily on certain aspects of the invention, whereas other aspects not discussed in any detail may be, in terms of structure, function, materials, etc., essentially as was described in reference to FIGS. 1 through 3. However, it will be appreciated that the teachings of the invention are more generally applicable to other types of cutting machines.

Figure 1:
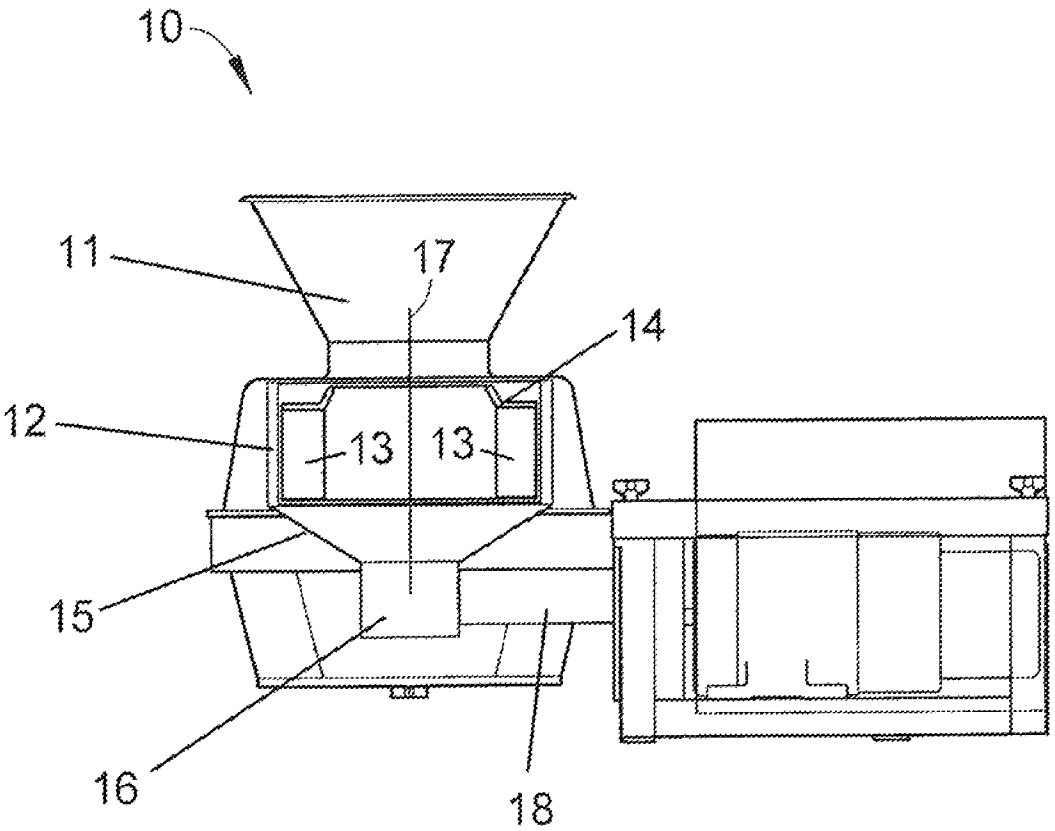
FIG. 1 PRIOR ART
FIG. 1 schematically represents a side view in partial cross-section of a slicing machine known in the art.

To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," etc., may be used in reference to the orientation of the cutting head 12 as it would be mounted in the machine 10 of FIG. 1. On the basis of a coaxial arrangement of the cutting head 12 and the impeller 14 of the machine 10, relative terms including but not limited to "axial," "circumferential," "radial," etc., and related forms thereof may also be used below to describe the nonlimiting embodiments represented in the drawings. All such relative terms are intended to indicate the construction and relative orientations of components and features of the cutting head 12, and therefore are relative terms that are useful to describe the illustrated embodiments but should not be otherwise interpreted as limiting the scope of the invention.

Figure 2:
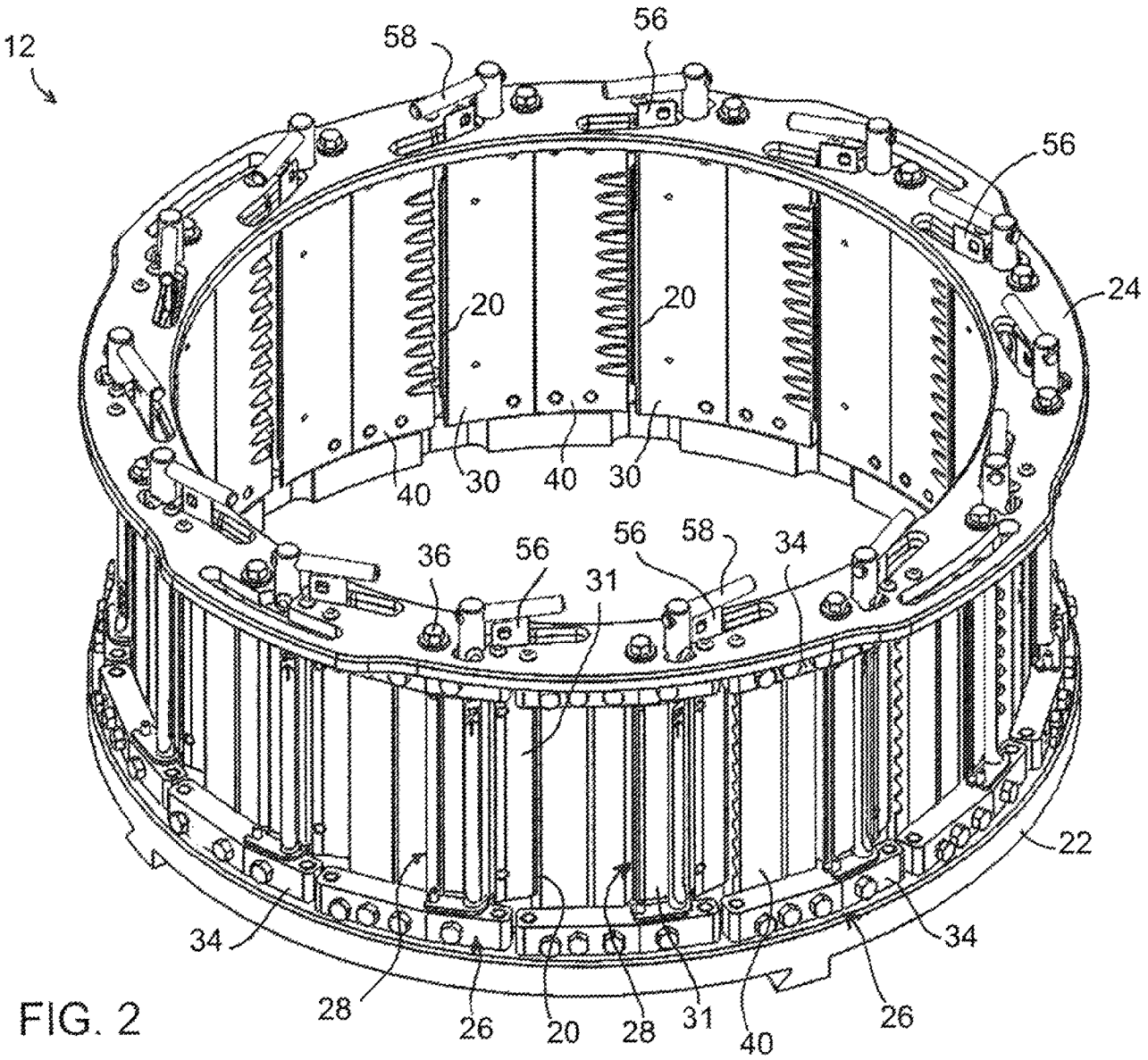
FIG. 2 is a perspective view representing a cutting head of a type suitable for use with the slicing machine of FIG. 1.
Figure 3:
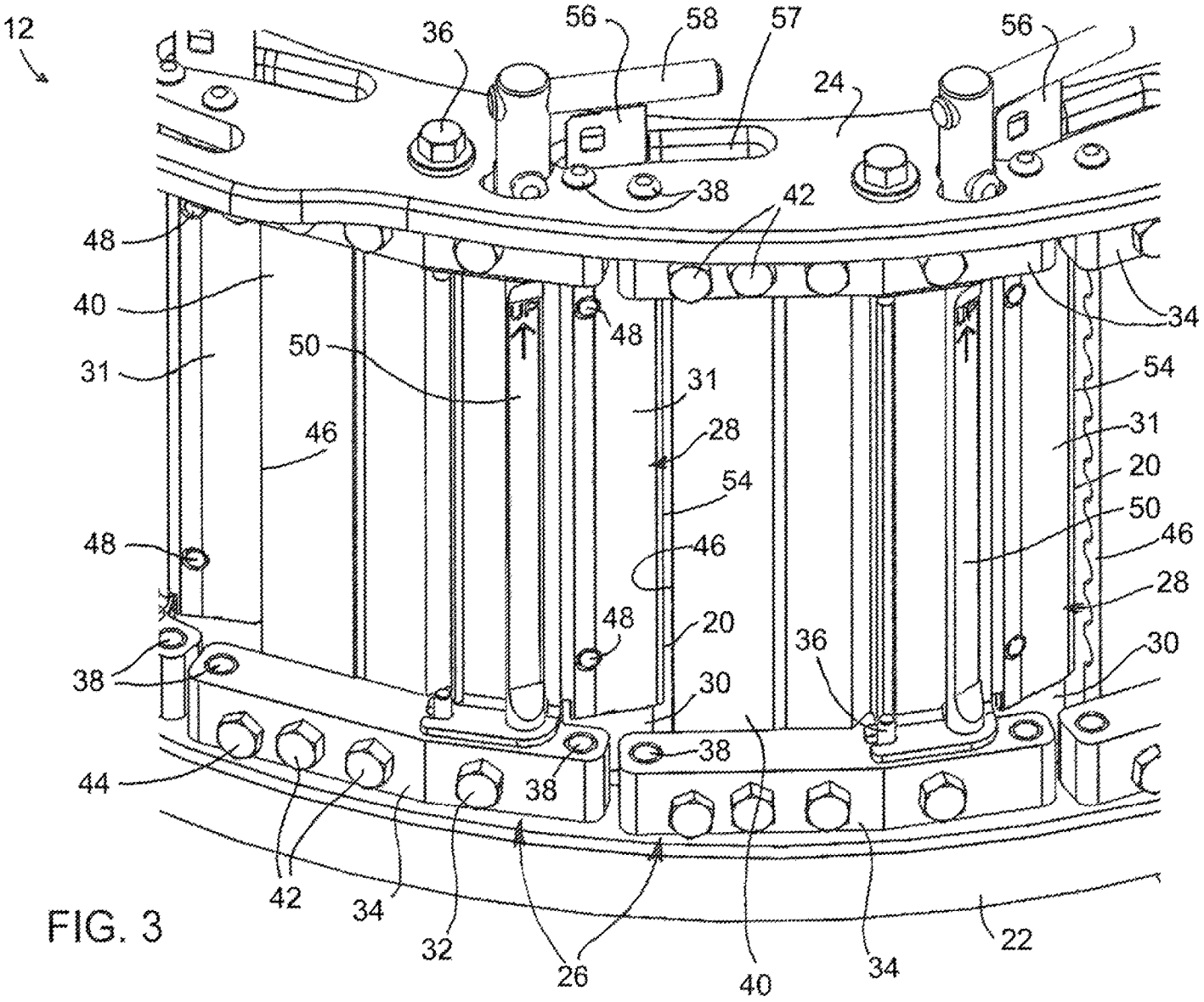
FIG. 3 is a detailed view showing a fragment of the cutting head of FIG. 3.
Figure 8:
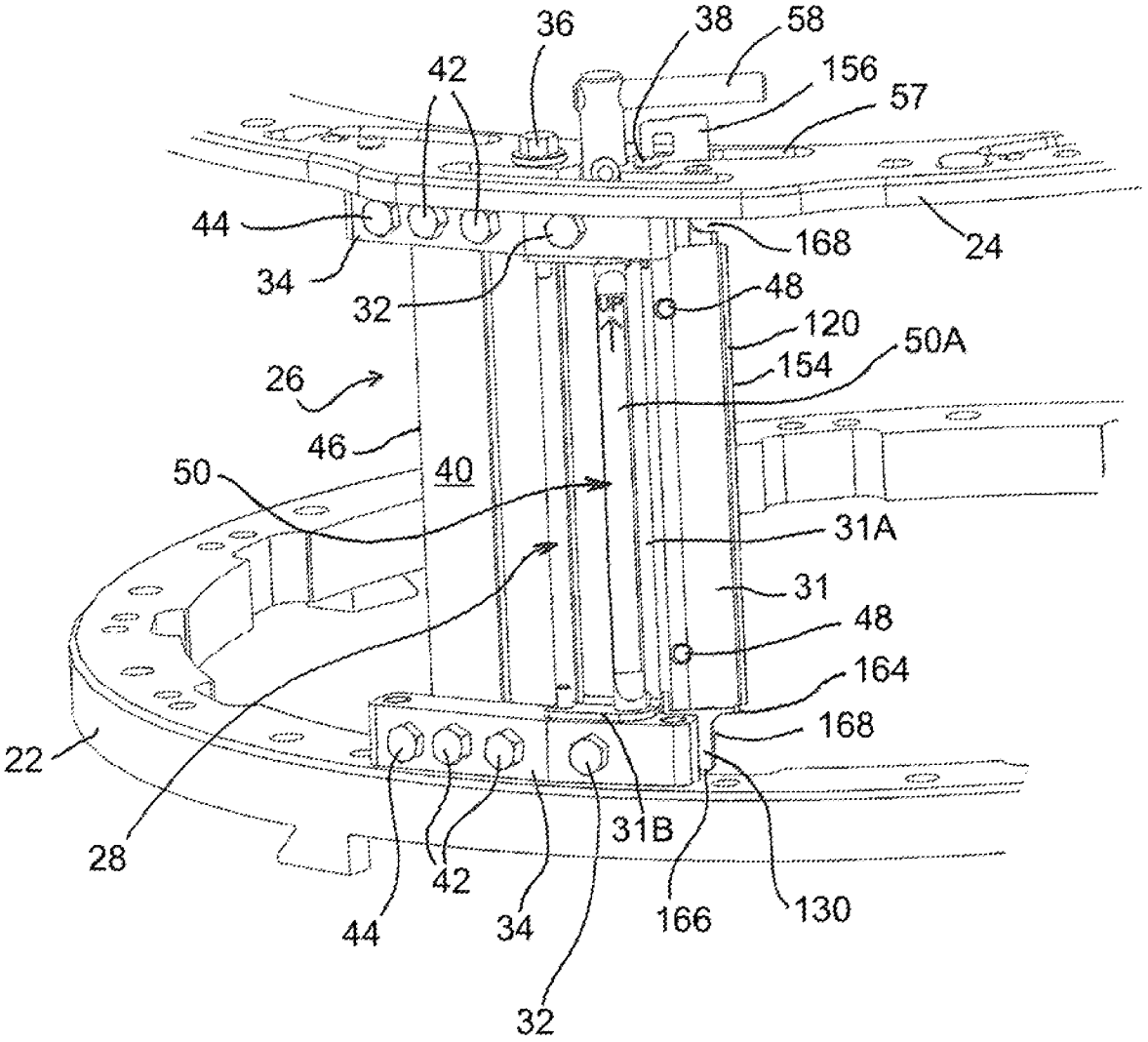
FIG. 8 shows a single slicing unit comprising the knife and knife holder of FIGS. 6 and 7 and assembled to support rings of the cutting head of FIGS. 2 and 3.
Figure 9:
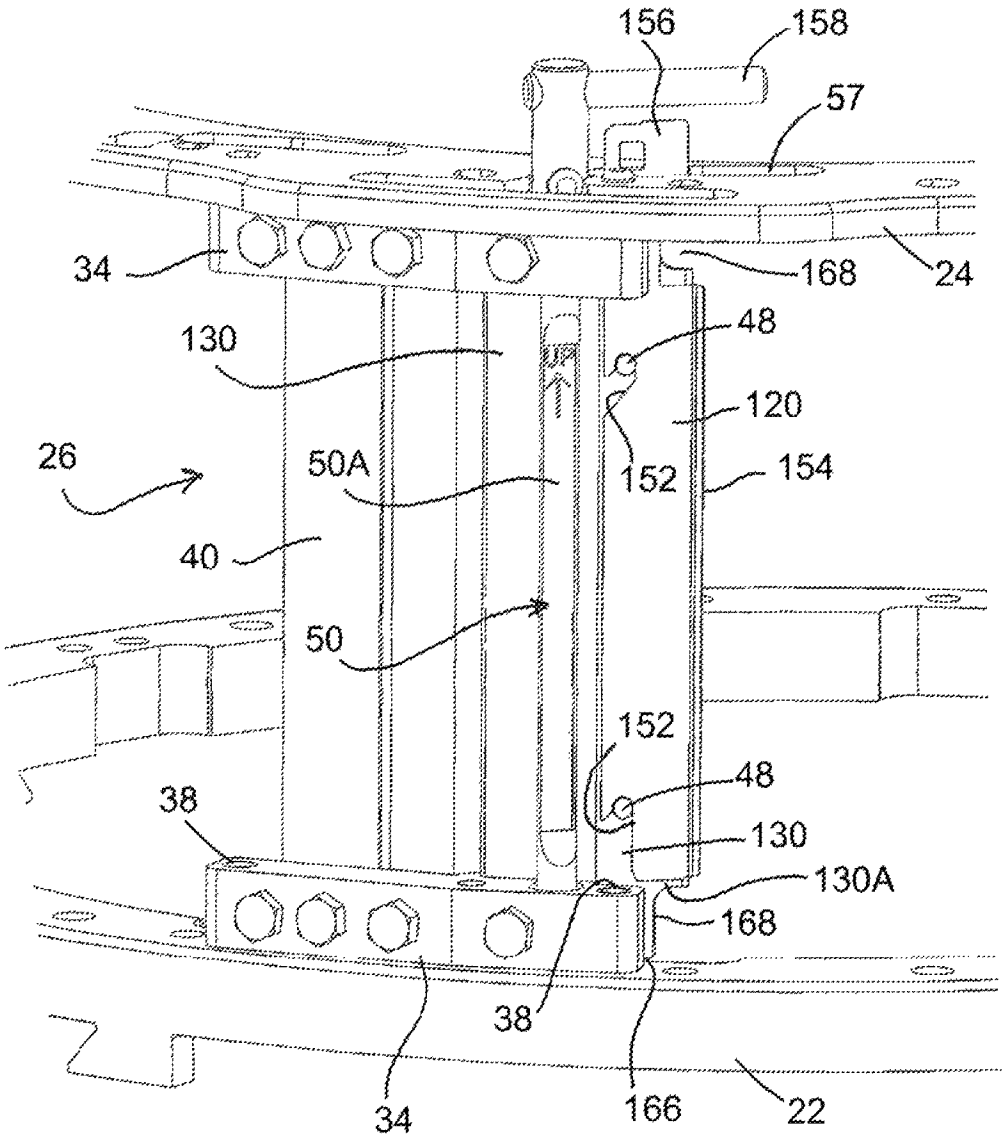
FIG. 9 shows the slicing unit of FIG. 8 with a clamp removed to reveal the knife and knife holder of the slicing unit.
Figure 10:
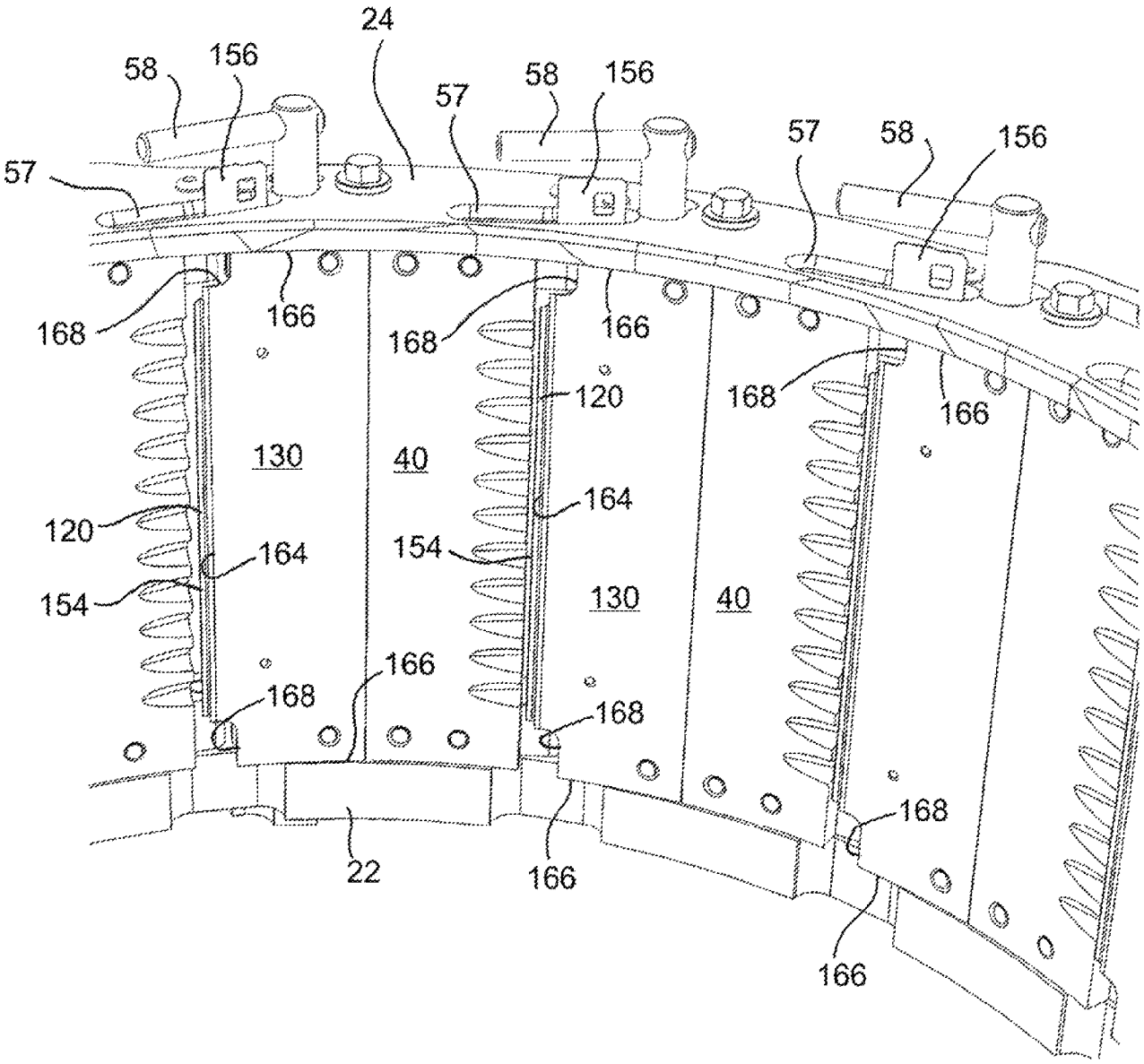
FIG. 10 is a detailed view showing an interior portion of the cutting head of FIGS. 2 and 3 in which knives and knife holders of the type shown in FIGS. 6 and 7 have been installed.

As represented in FIGS. 2 and 3, the cutting head 12 can be seen to be generally annular-shaped such that the knives 120 and knife holders 130 of FIGS. 6 and 7 are adapted to be mounted at its perimeter, as evident from the fragmentary views of FIGS. 8 and 10. FIGS. 6 and 8 through 10 represent the knife 120 as having a straight cutting edge 154 for producing flat slices, and as such may be referred to herein as "flat" knives, though the cutting head 12 can use knives of other shapes to produce corrugated (wavy), strip-cut, shredded and granulated products. Each knife 120 projects radially inward in a direction generally opposite the direction of rotation of the impeller 14 within the cutting head 12, and its cutting edge 154 is at its radially innermost extremity. As evident from the fragmentary views of FIGS. 8 through 10, each knife 120 and knife holder 130 is a member of a slicing unit 26, each of which is mounted to and between the lower and upper support rings 22 and ring 24 of the cutting head 12 to define a cutting station of the cutting head 12. Consistent with the cutting head 12 of FIGS. 2 and 3, the knives 120 are individually secured within the slicing units 26 by clamping assemblies 28. In combination, each knife 120 and its clamping assembly 28 constitutes what will be referred to herein as a knife assembly, an example of which is represented in FIG. 8.

Also consistent with the cutting head 12 of FIGS. 2 and 3, the knife holder 130 is mounted with fasteners 32 to and between a pair of mounting blocks 34, which in turn are secured to the support rings 22 and 24 with fasteners 36. Due to the positions of the rings 22 and 24 in the cutting head 12, the mounting blocks 34 of each slicing unit 26 are spaced apart in an axial direction of the cutting head 12. The fasteners 36 preferably rigidly secure the mounting blocks 34 to the rings 22 and 24. The clamping assembly 28 further includes a clamp 31 mounted between the mounting blocks 34 so that the clamp 31 is positioned on the radially outward-facing side of the knife holder 130 to secure the knife 120 thereto (in FIG. 9, the clamp 31 of the clamping assembly 28 has been omitted to reveal its knife 120). The clamp 31 is preferably pivotably mounted to the mounting blocks 34, and in the nonlimiting embodiment shown the fasteners 36 that secure the mounting blocks 34 to the rings 22 and 24 may extend through the blocks 34 to also serve as pivot pins for the clamp 31. The mounting blocks 34 are equipped with pins 38 that engage holes in the support rings 22 and 24. By appropriately locating the holes in the rings 22 and 24, the orientation of the mounting blocks 34, and consequently the knife 120, knife holder 130, and clamp 31 mounted thereto, can be used to alter the radial location of the cutting edge 154 of the knife 120 with respect to the axis of the cutting head 12, thereby providing relatively coarse control of the thickness of the sliced food product.

FIGS. 8 through 10 further show each slicing unit 26 as comprising an adjustable gate 40 secured to the mounting blocks 34 with fasteners 42. A food product crosses the gate 40 prior to encountering the knife 120 mounted to the succeeding slicing unit 26. To provide relatively fine control of the thickness of the sliced food product, the mounting blocks 34 are equipped with adjustment screws 44 that engage the gates 40 to alter the radial location of the trailing edge 46 of the gate 40 relative to the cutting edge 154 of the succeeding knife 120.

As shown in FIG. 8, the knife 120 is supported by a radially outer surface 130A of the knife holder 130, and the clamp 31 overlies the holder 130 so that the knife 120 is between the surface 130A of the holder 130 and a radially inward surface of the clamp 31 that faces the holder 130. Alignment of the knife 120, holder 130, and clamp 31 is achieved with pins 48 that protrude from the knife holder 130 into complementary slots 152 in the knife 120 (FIG. 9) and complementary holes in the clamp 31. By forcing the clamp 31 toward the holder 130, the clamp 31 applies a clamping force to the knife 120 adjacent its cutting edge 154 to clamp the knife 120 onto the surface 130A of the knife holder 130. Consistent with the cutting head 12 of FIGS. 2 and 3, an eccentric cam rod 50 is used as a quick-clamping feature to apply the clamping force to the clamp 31. However, it is foreseeable that other means for clamping or securing the knives 120 to their knife holders 130 could be employed, including but not limited to fasteners.

The embodiment of the cam rod 50 represented in FIGS. 2, 3, and 8 through 10 passes through holes in the mounting blocks 34 and through complementary holes on upstanding flanges 31B (FIG. 8) located at opposite ends of the clamp 31 to loosely assemble the clamp 31 to the mounting blocks 34 in combination with the pivot axis of the clamp 31 created by the fasteners 36. The cam rod 50 comprises a camming portion 50A that engages and disengages a surface 31A of the clamp 31 when the rod 50 is rotated between clamping and release positions, which serve to secure and release, respectively, the knife 120. The clamping position is depicted in FIG. 8, and results from the camming portion 50A being engaged with the clamp 31, whereas counter-clockwise rotation of the rod 50 (as viewed from above in FIG. 8) causes its camming portion 50A to eccentrically move out of engagement with the clamp 31, releasing the clamping force applied by the clamp 31 to the knife 120.

In the illustrated embodiment, the cam rod 50 is rotatably mounted to the mounting blocks 34 of the slicing unit 26 as a result of its oppositely-disposed ends being received in the holes formed in the blocks 34. The ends of the cam rod 50 are preferably coaxial, whereas the camming portion 50A between the ends is eccentric to the ends as well as the holes in which the ends are received, in other words, the axis of the camming portion 50A is parallel but not coaxial with the ends of the cam rod 50. The rod 50 is able to rotate within the holes between the aforementioned clamping and release positions. A handle 58 is provided at one end of the rod 50 to facilitate its rotation by hand. In the illustrated embodiment, the handle 58 is attached to the rod 50 so as to be disposed above the upper support ring 24 as seen in FIGS. 8 through 10.

FIGS. 6 through 10 further represent features of the knives 120 and knife holders 130 that, individually and in combination, provide benefits in terms of the operation of the cutting head 12 and characteristics of sliced products produced therewith. FIGS. 7 through 10 show the knife holder 130 as having a leading edge 164 that extends longitudinally between opposite ends 166 of the holder 130. When the knife 120 is clamped to the knife holder 130 by the clamp 31, its cutting edge 154 is adjacent to and projects beyond the leading edge 164 of the knife holder 130, as seen in FIG. 8. A notch or recess 168 is formed in each knife holder 130 where a corner would otherwise be defined by the intersection of the leading edge 164 and ends 166 of a holder 130. The recesses 168 are defined in the knife holders 130 so as to be adjacent one of the support rings 22 or 24 and define a gap between the leading edge 164 of the knife holder 130 and the adjacent support ring 22 or 24. The gaps defined by the recesses 168 discourage the accumulation of matter, for example pieces of the product being sliced, that might otherwise collect where the knife holders 130 meet the support rings 22 and 24. The recesses 168 also facilitate the cleaning of the cutting head 12 from its exterior, for example, by allowing a cleaning spray to be directed into the interior of the head 12 through the recesses 168. As such, the recesses 168 promote the efficient and sanitary operation of the cutting head 12, the latter of which is particularly notable if the product being sliced is a food product. Though the recesses 168 are depicted as concave and arcuate in shape, other shapes are foreseeable. The recesses 168 are represented as being dimensionally greater in the longitudinal direction of each holder 130 than in the lateral direction of the holder 130 to promote the benefits of the recesses 168 without interfering with the function of the knife holders 130.

Figure 4:
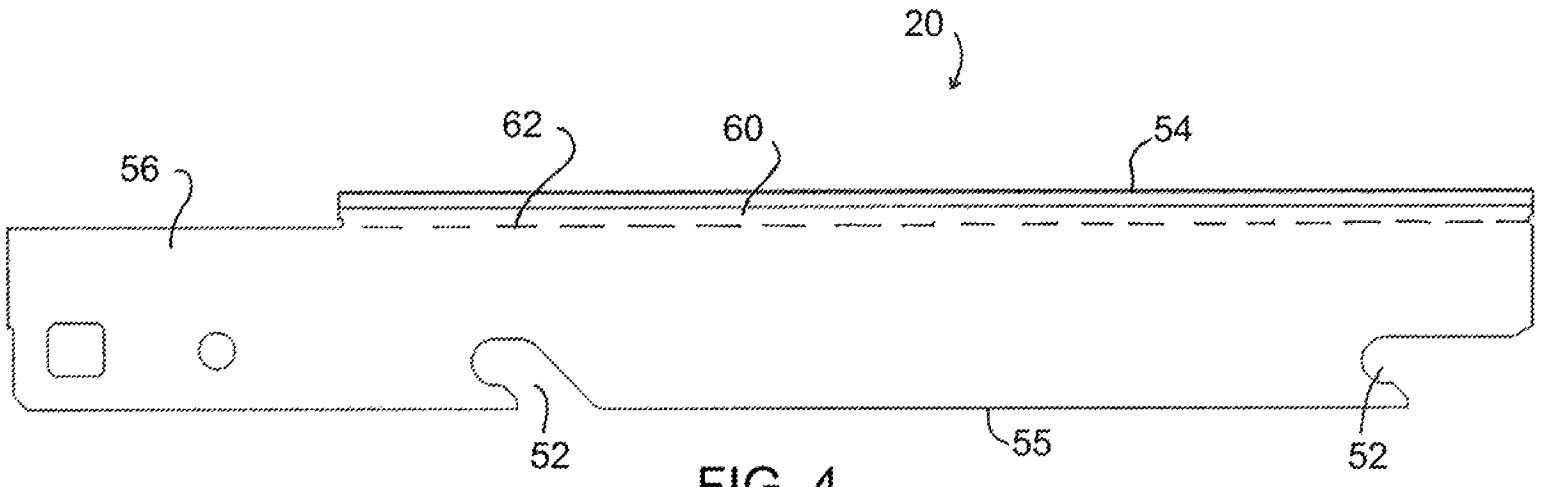
FIG. 4 Prior Art
FIGS. 4 and 5 show isolated views of knives of types capable of use in the cutting head of FIGS. 2 and 3.
Figure 5:
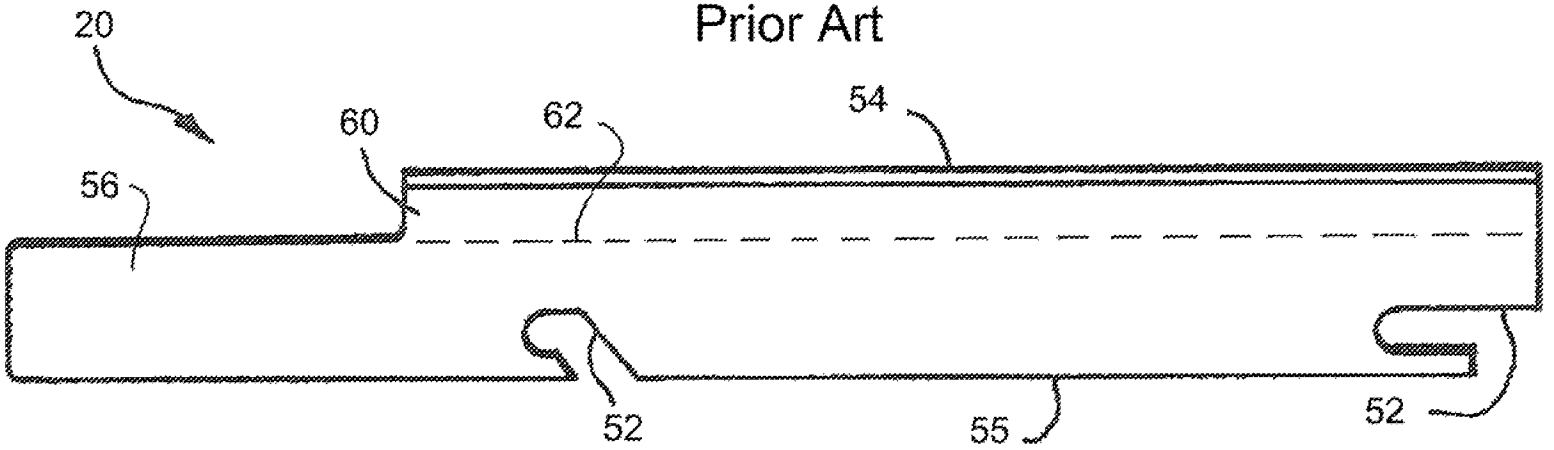
FIG. 5 Prior Art

FIG. 6 shows the knife 120 as having an edge 155 oppositely disposed from its cutting edge 154, and the edges 154 and 155 both extending along a longitudinal length of the knife 120. FIGS. 6 and 8 through 10 show the knife 120 as further having a handle 156 at one longitudinal end that has a size and shape that enable the handle 156 to protrude through an opening 57 in the upper support ring 24. The handle 156 has a lateral width measured between the opposing edge 155 of the knife 120 and a third edge 174 that is formed by the handle 156 and is roughly parallel to the cutting and opposing edges 154 and 155. The handle 156 enables the knife 120 to be grasped and easily removed from the cutting head 12 after the clamping force applied by the clamp 31 to the knife 120 has been released (by rotating the rod 50). As most readily seen by the individual knife 120 shown in FIG. 6, the knives 120 are configured differently from the prior art knives 20 of FIGS. 4 and 5. The lateral width of the knife handle 156 is similar to the lateral width of the handle 56 of the knife 20 shown in FIG. 4 in relation to the lateral width of the knife 120 between its cutting and opposing edges 154 and 155. As such, the width of the handle 156 is sufficient to enable the knife 120 to be more easily grasped and removed from the cutting head 12 than the knife 20 shown in FIG. 5. However, the knife 120 further has a reduced-width transition region 170 between the handle 156 and the remainder of the knife 120, i.e., between the cutting and opposing edges 154 and 155. The transition region 170 is shown as having a minimum lateral width of roughly one half of, which includes slightly greater than, the lateral width between the cutting and opposing edges 154 and 155 of the knife 120, with the result that a portion 160 of the knife 120 that laterally extends beyond the transition region 170, as visualized by the extension line 162 of the transition region 170, is roughly half of, which includes slightly less than, the lateral width of the knife 120 between its cutting and opposing edges 154 and 155. The narrower transition region 170 of the knife 120 enables the clamping force applied by the clamp 31 to be primarily applied through contact with the portion 160 of the knife 120 extending beyond the handle 156. In so doing, the additional rigidity contributed by the handle 156 to the knife 120 does not influence the flexing of the knife 120 between the knife holder 130 and clamp 31, with the result that the knife 120 can more fully and uniformly engage the radially outer surface 130A of the knife holder 130. As a result, a gap that might otherwise be present between the knife 120 and the surface 130A of the knife holder 130 is greatly reduced if not eliminated, which promotes the sanitary operation of the cutting head 12.

As portrayed in FIG. 6, the transition region 170 is formed as a result of a recess 172 being defined between the cutting edge 154 and the third edge 174 of the handle 156, and is therefore juxtaposed with the cutting edge 154. The recess 172 is delimited by a lateral edge 172A contiguous with and roughly perpendicular to the cutting edge 154, a longitudinal edge 172B that is contiguous with the lateral edge 172A and roughly parallel to the cutting and opposing edges 154 and 155, and a transition edge 172C that is contiguous with the longitudinal edge 172B of the transition region 170 and the third edge 174 of the handle 156. The transition edge 172C is not parallel or perpendicular to the cutting, opposing, or third edges 154, 155, and 174, such that the lateral width of the transition region 170 gradually increases from the minimum width between its longitudinal edge 172B and the opposing edge 155, to the third edge 174 of the handle 156. In so doing, potentially sharp corners are not created by the presence of the transition region 170 between the cutting edge 154 and handle 156. Though the recess 172 and the edges 172A, 172B, and 172C that define it are depicted as being rectilinear in shape, it is foreseeable that any or all of the edges 172A, 172B, and 172C defining the recess 172 could have curvilinear shapes.

While the invention has been described in terms of specific or particular embodiments, it should be apparent that alternatives could be adopted by one skilled in the art. For example, the machine 10, cutting head 12, impeller 14, slicing units 26, and their respective components could differ in appearance and construction from the embodiments described herein and shown in the drawings, functions of certain components could be performed by components of different construction but capable of a similar (though not necessarily equivalent) function, and various materials could be used in the fabrication of the machine 10, cutting head 12, impeller 14, slicing units 26, and their respective components. As such, it should be understood that the above detailed description is intended to describe the particular embodiments represented in the drawings and certain but not necessarily all features and aspects thereof, and to identify certain but not necessarily all alternatives to the represented embodiment and described features and aspects. As a non-limiting example, the invention encompasses additional or alternative embodiments in which one or more features or aspects of the disclosed embodiments could be eliminated, or certain features of different embodiments could be combined. Accordingly, it should be understood that the invention is not necessarily limited to any embodiment described herein or illustrated in the drawings, and the phraseology and terminology employed above are for the purpose of describing the illustrated embodiment and do not necessarily serve as limitations to the scope of the invention. Therefore, the scope of the invention is to be limited only by the following claims.

The invention claimed is:

1. A knife comprising:

A knife for using with a knife assembly of a slicing machine, the knife comprising: a cutting edge and an opposing edge oppositely disposed from the cutting edge, the cutting and opposing edges extending along a longitudinal length of the knife;

a handle at a longitudinal end of the knife, the handle having a lateral width that is defined by the opposing edge and a third edge of the handle; and a transition region between the cutting edge and the handle, the transition region being formed at least in part by a recess that is oppositely disposed from the opposing edge and contiguous with the cutting edge, the transition region having a minimum lateral width of roughly one half of a lateral width between the cutting and opposing edges of the knife, with the result that a portion of the knife that laterally extends beyond the transition region and away from the handle is roughly half of the lateral width of the knife between the cutting and opposing edges;

wherein the recess is between the cutting edge and the third edge on the handle that defines the lateral width of the handle with the opposing edge;

wherein the recess is delimited by a lateral edge contiguous with and roughly perpendicular to the cutting edge, a longitudinal edge that is contiguous with the lateral edge, straight, and parallel to the cutting and opposing edges, and a transition edge that is contiguous with the longitudinal edge and the third edge of the handle; and wherein the transition edge is not parallel to and is not perpendicular to the cutting, opposing, or third edges, such that the lateral width of the transition region increases from a minimum width between the longitudinal edge and the opposing edge, to the third edge of the handle, wherein the knife is mounted to the knife assembly.

2. The knife of claim 1, wherein the third edge is straight and parallel to the cutting and opposing edges.

3. The knife of claim 1, wherein the recess is juxtaposed with the cutting edge and is delimited by an edge that is contiguous with the cutting edge.

4. A knife assembly comprising the knife of claim 1, the knife assembly having a clamping assembly comprising:

a knife holder having an outer surface; and a clamp that applies a clamping force to the knife to secure the knife to the outer surface of the knife holder.

5. The knife assembly of claim 4, wherein the third edge is straight and parallel to the cutting and opposing edges.

6. The knife assembly of claim 4, wherein the recess is juxtaposed with the cutting edge and is delimited by an edge that is contiguous with the cutting edge.

7. The knife assembly of claim 4, wherein the clamping force applied by the clamp is primarily applied through contact with the portion of the knife that laterally extends beyond the handle.

8. The knife assembly of claim 4, wherein the clamping force applied by the clamp is primarily applied through contact with the portion of the knife that extends beyond the handle so that additional rigidity contributed by the handle to the knife does not influence the flexing of the knife between the knife holder and clamp with the result that the knife more fully and uniformly engages the outer surface of the knife holder.

9. The knife assembly of claim 4, wherein the knife holder comprises a leading edge that extends longitudinally between opposite ends of the knife holder, the knife is clamped to the knife holder by the clamp so that the cutting edge of the knife is adjacent to and projects beyond the leading edge of the knife holder, and the knife holder has at least one recess at a corner defined by an intersection of the leading edge of the knife holder and one of the ends of the knife holder.

10. A slicing machine comprising a cutting head and a knife assembly mounted to the cutting head, the knife assembly comprising:

a knife comprising:

a cutting edge and an opposing edge oppositely disposed from the cutting edge, the cutting and opposing edges extending along a longitudinal length of the knife;

a handle at a longitudinal end of the knife, the handle having a lateral width that is defined by the opposing edge and a third edge of the handle; and a transition region between the cutting edge and the handle, the transition region being formed at least in part by a recess that is oppositely disposed from the opposing edge and contiguous with the cutting edge, the transition region the transition region having a minimum lateral width of roughly one half of a lateral width between the cutting and opposing edges of the knife, with the result that a portion of the knife that laterally extends beyond the transition region and away from the handle is roughly half of the lateral width of the knife between the cutting and opposing edges;

wherein the recess is between the cutting edge and the third edge on the handle that defines the lateral width of the handle with the opposing edge;

wherein the recess is delimited by a lateral edge contiguous with and roughly perpendicular to the cutting edge, a longitudinal edge that is contiguous with the lateral edge, straight, and parallel to the cutting and opposing edges, and a transition edge that is contiguous with the longitudinal edge and the third edge of the handle; and wherein the transition edge is not parallel to and is not perpendicular to the cutting, opposing, or third edges, such that the lateral width of the transition region increases from a minimum width between the longitudinal edge and the opposing edge, to the third edge of the handle;

a knife holder having an outer surface; and a clamp that applies a clamping force to the knife to secure the knife to the outer surface of the knife holder.

11. The slicing machine of claim 10, wherein the third edge is straight and parallel to the cutting and opposing edges.

12. The slicing machine of claim 10, wherein the recess is juxtaposed with the cutting edge and is delimited by an edge that is contiguous with the cutting edge.

13. The slicing machine of claim 10, wherein the clamping force applied by the clamp is primarily applied through contact with the portion of the knife that extends beyond the handle.

14. The slicing machine of claim 10, wherein the clamping force applied by the clamp is primarily applied through contact with the portion of the knife that extends beyond the handle so that additional rigidity contributed by the handle to the knife does not influence the flexing of the knife between the knife holder and clamp with the result that the knife more fully and uniformly engages the outer surface of the knife holder.

15. The slicing machine of claim 10, wherein the cutting head is an annular-shaped cutting head comprising axially-spaced support rings, the knife assembly is mounted to and between the support rings, the slicing machine further comprises an impeller coaxially mounted within the cutting head for rotation about an axis of the cutting head in a rotational direction relative to the cutting head, and the knife extends radially inward toward the impeller in a direction opposite the rotational direction of the impeller.

16. The slicing machine of claim 15, wherein the knife holder comprises a leading edge that extends longitudinally between opposite ends of the knife holder, the knife is clamped to the knife holder by the clamp so that the cutting edge of the knife is adjacent to and projects beyond the leading edge of the knife holder, and the knife holder has at least one recess at a corner defined by an intersection of the leading edge of the knife holder and one of the ends of the knife holder, the recess defining a gap between the leading edge of the knife holder and an adjacent one of the support rings of the cutting head.

* * * * *